United States Patent [19]

Beard

[11] 3,979,163

[45] Sept. 7, 1976

[54] CLEANING AND SCRUBBING TOOL

[75] Inventor: Walter C. Beard, Middlebury, Conn.

[73] Assignee: Aerosol Techniques Incorporated, Milford, Conn.

[22] Filed: June 16, 1975

[21] Appl. No.: 586,902

[52] U.S. Cl. ..... 401/139; 401/190; 401/266; 401/196

[51] Int. Cl.[2] ..... A47L 13/26

[58] Field of Search ..... 401/190, 136, 137, 139, 401/266, 196; 222/182, 192; 15/245

[56] References Cited

UNITED STATES PATENTS

| | | | |
|---|---|---|---|
| 3,240,397 | 3/1966 | Sagarin | 222/182 |
| 3,370,908 | 2/1968 | Cupp | 401/190 |
| 3,565,541 | 2/1971 | Vallis | 401/190 X |
| 3,645,821 | 2/1972 | Baumann | 15/244 R X |
| 3,784,063 | 1/1974 | Otis et al. | 401/190 X |
| 3,885,715 | 5/1975 | Lowry | 222/182 |

*Primary Examiner*—Lawrence Charles
*Attorney, Agent, or Firm*—Louis J. Bachand

[57] ABSTRACT

Cleaning and scrubbing tool having a clearing head and aerosol can handle in which a suitably operational scrub pad is supported by head bracket extension in free cleaning liquid passing relation, interlocked with portions of the pad by localized deflection of the extension, suitably by locally heating or solvating the extension to deflectable condition within the pad interior.

9 Claims, 7 Drawing Figures

Fig. 4.
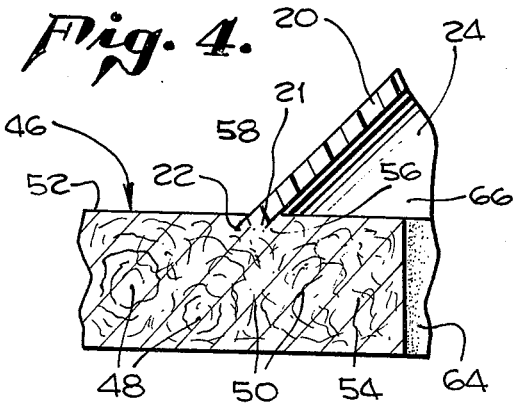
Fig. 6a
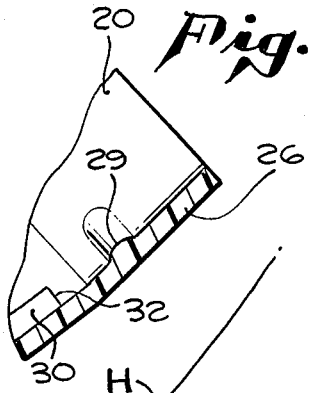
Fig. 1.
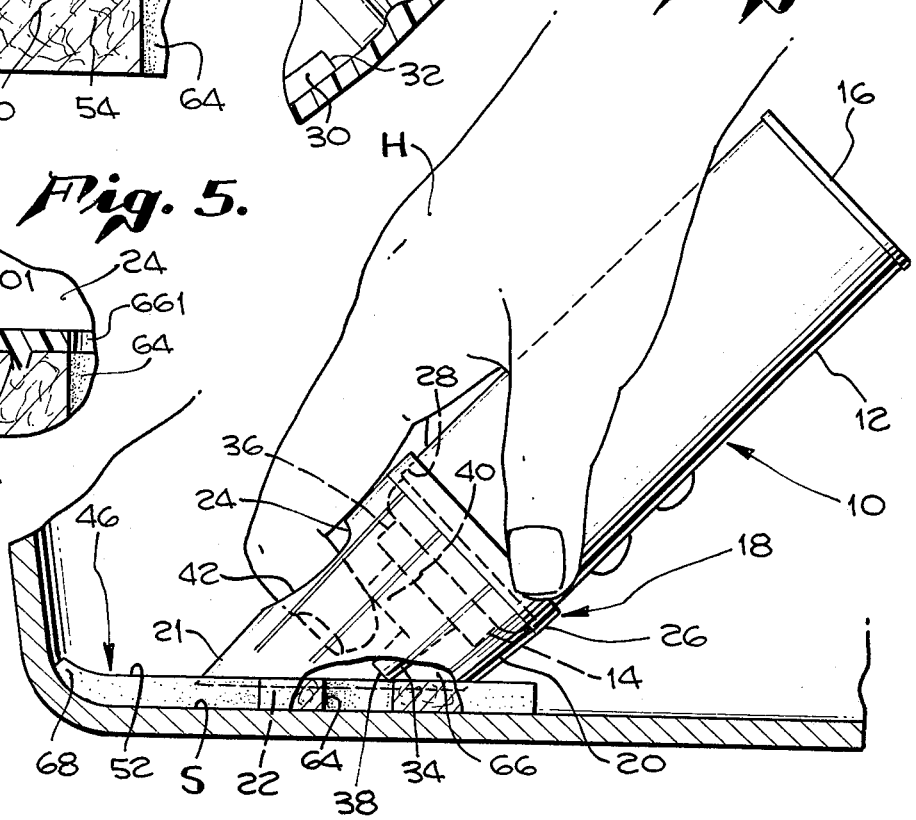
Fig. 5.
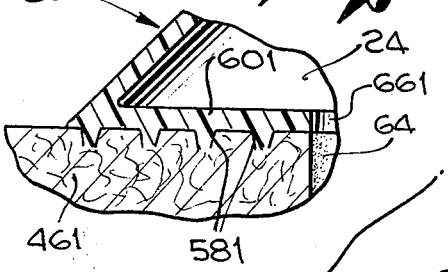
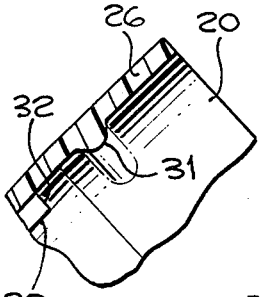
Fig. 6b
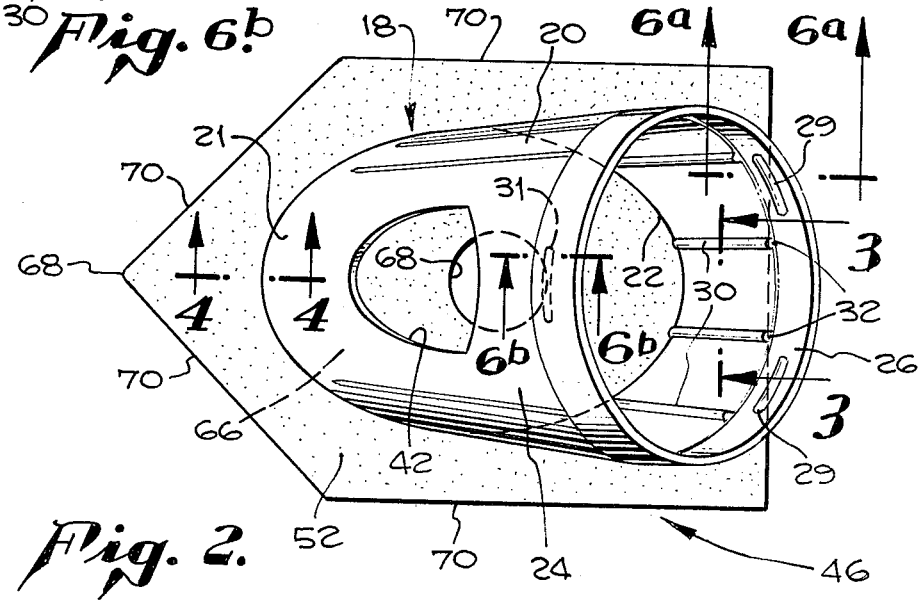
Fig. 3.
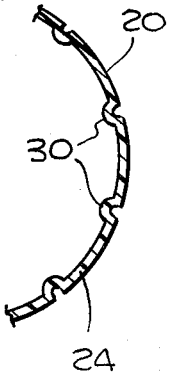
Fig. 2.

CLEANING AND SCRUBBING TOOL

BACKGROUND OF THE INVENTION

This invention has to do with household and light industrial cleaning and scrubbing tools and is more particularly concerned with improvements in the ease of manufacture of such tools based on aerosol-delivered cleaning materials, and in their construction for greater convenience and efficiency in use, with improved effectiveness in cleaning, and heightened efficiency in cleaning liquid utilization and reutilization to provide a successful system for untrammeled delivery of cleaning liquid to the surface to be scrubbed for conversion there into an active foam form by scrub pad working action thereon.

PRIOR ART

Scrub tools of various kinds are known including those used with or even coupled to an aerosol can which doubles as the source of cleaning liquid or foam and the handle for manipulation of the scrub tool. For the purpose, there have been devised cleaning heads of different designs carrying bristles, sponges, and other kinds of scrub structures. A deficiency in these devices appears to be in the inability thereof to both deliver cleaning liquid freely of the scrub structure i.e. right directly onto the surface to be scrubbed, by-passing the scrub structure, and also to act and react with the cleaning liquid so delivered to agitate, foam and work the cleaning liquid against the surface to be scrubbed, in a manner improving the sudsing-scrubbing action of the cleaning liquid. That is prior devices have failed to provide both these features to the detriment of cleaning speed and effectiveness, and therefore, efficiency.

SUMMARY OF THE INVENTION

It is a major objective therefore of the present invention to provide a new and improved scrub tool having both the ability to deliver cleaning liquid directly to the surface to be scrubbed and to work such liquid against the surface for maximum cleaning effect and repeatedly, all with the ease of aerosol delivery and manipulation of the scrub head by an aerosol can. A further important objective is to provide a new construction of cleaning tool in which scrub pad support on the aerosol can is readily and reliably realized by simple manufacturing techniques, while preserving the in-use benefits noted. Still another objective is to secure a scrub pad interiorly onto a cleaning head bracket without clamps or fittings or other devices limiting the utility of the produced article for scrubbing purposes.

These and other objects of the invention, to become apparent hereinafter are achieved through the provision by the invention of an in-use regenerable, hand-held surface cleaning and scrubbing tool having a cleaning-scrubbing head, and a cleaning liquid containing aerosol can having a finger-actuable nozzle for directional delivery of cleaning liquid therefrom on to a surface to be scrubbed and forming a handle for scrubbing manipulation of the head. The cleaning head comprises a bracket rigidly supported on the can in nozzle surrounding relation and a locally apertured fluid permeable, resilient scrub pad having interior reticulations carried by the bracket with its aperture disposed opposite the nozzle opening for free fluid passage through the pad aperture onto the surface to be scrubbed of the cleaning liquid. The scrub pad is coupled to the bracket by bracket extensions within the pad interior having adherent or interlocking engagement with the reticulation-defining portions of the pad.

The pad may be sponge-like, fibrous or of other construction. The bracket is generally cylindrical and its bracket extensions generally locally deflectable within the pad interior to define the interlocking engagement. Additionally, the bracket typically defines a finger access hole adjacent the can nozzle. In preferred embodiments the bracket and bracket extension are formed of synthetic organic thermoplastic material. In alternative embodiments the bracket extension may be discontinuous within the pad interior and locally flow-deflected into interlocking engagement with e.g. pad fibers. Or, the bracket extension may be circularly continuous within the pad interior and locally flow-deflected into interlocking engagement with the pad fibers. Generally, the plane of the bracket extension intersects the can access at an angle of about 45° for convenience in scrub manipulation.

With reference particularly to the pad attributes on the bracket, the pad may be peripherally unsupported for a conforming engagement with curved surfaces to be scrubbed and the pad may be forwardly tapered beyond the bracket for convenience in entering corners. In particular embodiments the pad comprises a reticulated mat of short fibers bonded at their intersections to define the pad reticulations, the bracket extension then being locally deflected into fiber-interlocked engagement. The bracket extension where thermoplastic may be locally fused around the pad fibers.

In a highly preferred form of the invention, there is provided in an in-use regenerable, hand-held surface cleaning and scrubbing tool comprising a fluid-permeable resilient scrub pad having interior reticulations, a pad support bracket, and a hand-holdable aerosol can containing cleaning liquid under dispensing pressure, the can defining a bracket handle for scrubbing manipulation of the pad and having a finger-actuable nozzle for directional delivery of cleaning liquid therefrom repetitively on to a surface during scrubbing, the pad having an aperture freely passing directionally-delivered cleaning liquid from the nozzle directly onto the surface to be releaseably absorbed into the pad from the surface during scrubbing, the bracket having an opening in registration with the pad aperture, the pad engaging means comprising a bracket extension surrounding the bracket opening and projecting into the pad circumferentially of the pad aperture and in locally deflected, interlocking relation with the interior pad portions defining the pad reticulations, to support the pad during scrubbing operation-regeneration of absorbed cleaning liquid in the pad and responsive to repeated surface delivery of the cleaning liquid onto the surface through the registered bracket opening and pad aperture. The pad engaging means may comprise synthetic organic thermoplastic resin locally deflectable upon heating or solvation into the interlocking relation described. The bracket extension forming the pad engagement means may define a generally curvilinear continuous edge within the pad interior or the bracket extension may comprise a plurality of discrete padpenetrating elements individually locally deflectable into interlocking relation with the pad portions defining pad reticulations. In either event, the bracket extension may be flowed by heat or solvent into interlocking engagement with the adjacent interior pad portions, or fused therewith as described.

In certain embodiments the bracket may be releasably retained on the can for reuse with successive cans of cleaning liquid and for the purpose there may be provided means supporting the bracket on the cans comprising bracket continuations defining circularly differentiated detent structure in can chime engagement, arranged to releasably retain the bracket on the can rearwardly of the nozzle for bracket separation on tipping of the cleaning head relative to the can, but firmly securing the cleaning head to the can in the scrubbing orientation of the can i.e. with the scrub pad pressed into planar engagement with the surface to be cleaned.

Additionally, the invention contemplates method of manufacture of such scrubbing tools, i.e. tools having a cleaning head surmounting an aerosol can of cleaning liquid, the cleaning head comprising a bracket having a bracket extension and a scrub pad having interior reticulations and carried by the bracket by the bracket extension, which includes abutting the pad and bracket extension in interpenetrating relation and locally flow-deflecting the bracket extension portion within the pad into interlocking engagement with the pad portion defining the pad reticulations. For this purpose the bracket extension may be locally heated to flowing condition or locally solvated to such flowing condition.

BRIEF DESCRIPTION OF THE DRAWINGS

The invention will be further described as to an illustrative embodiment in conjunction with the attached drawings in which:

FIG. 1 is a view in elevation and partly in section of the scrubbing tool of the invention in cleaning use;

FIG. 2 is a plan view of the cleaning head of the invention scrubbing and cleaning tool;

FIG. 3 is a view taken on line 3—3 in FIG. 2;

FIG. 4 is a detail view greatly enlarged of the interlocking engagement of the cleaning head bracket and the scrub pad;

FIG. 5 is a view like FIG. 4 of an alternate form of interlocking relationships therebetween;

FIG. 6(*a*) is a detail view somewhat enlarged of the smaller rearward detent structure taken on line 6(*a*) — 6(*a*) in FIG. 2; and FIG. 6(*b*) is a detail view like FIG. 6(*a*) of the larger, forward detent structure taken on line 6(*b*) — 6(*b*) in FIG. 2.

With reference now to the drawings, in detail, the cleaning and scrubbing tool according to the invention is shown at 10 in FIG. 1 held by hand H in use orientation. The tool 10 comprises an elongated, cylindrical aerosol can 12 of conventional construction with crimped-on top and bottom portions 14, 16 respectively. The can 12 is conveniently of easily hand-held size, as shown, so that the can defines a handle for manipulation of the cleaning head 18. The can 12 is typically filled with cleaning liquid e.g. an aqueous solution of detergent, enzymatic material and/or organic solvent adjuvants to cleaning and under aerosol propellant pressure.

With reference to FIGS. 1 and 2 particularly, the cleaning head 18 comprises a generally tubular, ungular plastic body 20 having an extension 21 cut at an angle of about 45° to the vertical to provide an oval, uniplanar lip 22 defined by the tubular wall 24 of the body. The body 20 terminates at the opposite end in a slightly flexed skirt 26 which is sized to snugly overfit the chime 28 of the can 12; this gripping derived from the elastic memory of the plastic material from which the body 20 is made e.g., of polyethylene, polypropylene, styrene polymer or copolymers of these and like synthetic organic thermoplastic polymers which are moldable or extrudable into the desired tubular configuration, rigid enough in use and resistant to deformation by hot water and stress cracking in the presence of surface active agents such as detergents, and commonly encountered cleaning solvents.

As best seen in FIGS. 2 and 3 the tubular body 20 is provided interiorly with integral circularly spaced vertical ribs 30 which terminate at the commencement of the body skirt 26 defining there a circular series of stop shoulders 32 which abut the can chime 28 when the cleaning head 18 is seated on the can 12, as shown in FIG. 1. Below the rib 30 termination, and spaced approximately the typical thickness of an aerosol can chime (e.g., at 28 in FIG. 1) there is provided a circular series of detents formed as inward projecting lugs 29, 31 on bracket continuation or skirt 26 to engage the chime on the underside. As will be seen from a consideration of FIGS. 6(*a*) and 6(*b*) the relatively rearward (relative to the liquid delivery direction of the nozzle) detent lugs 29 have a lesser inward projection than opposite lug 31 which is forward of the nozzle. Thus, circularly differentiated in projection distance, the lugs 29, 31 offer different resistance to movement of the bracket skirt 26 over the can chime 29. The lesser projecting lugs 29 thus preferentially releasably retain the bracket and thus the cleaning head on the can for ease of removal by tipping relative to the can longitudinal axis, while the front lug 31, being of greater inward projection firmly holds the bracket in place during scrubbing manipulation of the can, an operating mode putting relatively little pressure on the lugs 29.

The tubular vertical extent of the body 20 surrounds the conventional valved nozzle and assembly 34 which is fitted into the top 36 of the can 12. An axial delivery orifice 38 is provided having a finger actable button control 40 therebelow to open the valve (not shown). Opposite the finger button 40 the body 20 has a finger access hole 42 formed in the body wall 24 enabling insertion of e.g. an index finger through the hole onto the button control. The placement of the button control 40 and the finger hole 42 is such that a hand H gripping the can and applying pressure thereby to the cleaning head against the surface S to be cleaned is nonetheless enabled to make repetitive actuations of the button during scrubbing manipulation, to effect successive discharge of the cleaning liquid from the can for purposes to appear.

A scrub pad 46 completes the cleaning head 18. The scrub pad 46 is anchored to the oval lip 22 of the body 20 by engaging means to be subseqently described herein. The pad 46 may be any of various constructions such as sponge, woven or nonwoven mat, and the like which are substantially self-supporting, porous, resilient, water permeable, resistant to abrasion, solvents, surfactants, hot water, alkalies and other hostile factors encountered in cleaning. In general the permeability and porosity characteristics are found in a pad 46 having an internal serial openness which are termed herein reticulations 48 such as may be formed by a mass of intersecting fibers 50 joined one to the other at their points of intersection, e.g., by a viscous cement, the fibers being plastic and coated with abrasive in some instances. The pad reticulations formed by the thus randomly or regularly reticulated fibers serve as reservoirs of cleaning solution, provide resiliency, alternately absorb and discharge the cleaning solution contributing to foaming thereof and otherwise contribute to the effective working of the cleaning solutions against the surface to be scrubbed.

These important attributes of the scrub pad 46 are retained in the invention tool 10 while at the same time firmly securing the pad to the cleaning head body 20. The means of securement of the pad 46 to the body 20 is an important aspect of the invention. For purposes of engagement of the pad 46 and body 20, the body lip 22 is adapted to penetrate beyond the plane face 52 of the pad into the pad interior 54 where it contacts the pad portions e.g., 56 defining the pad reticulations 48 noted above. Further, it is characteristic that the body lip 22 be locally deflectable into interlocking engagement with those pad portions. With reference particularly to FIG. 4, the body lip 22 is shown in interpenetrated relation with the pad 46. Prior to or upon such penetration the lip was rendered flowable, by heat or solvent conditioning whereby local portions 58 of the lip have flowed around, across and between the fibers within the pad, and upon losing flowability, i.e., hardening, the fibers have been embedded in the now deflected lip portions. Application of pressure to the flow-conditioned lip portions will facilitate fiber interengagement therewith and the formation of interlocking relationships which will securely bind the pad 46 to the cleaning head body 20.

An alternate form of pad-body engagement is shown in FIG. 5 where pad 461 is engaged with projecting engagement structure in the form of a plurality of penetrating elements 581 e.g., spikes rising from a platform 601 extending across the end of head body 20. That is, the platform 601 with its spike elements 581 is in substitution of the narrow edge of lip 22 for pad penetration. The spike elements 581 are flow-conditioned by heat or solvent for deflection into the pad reticulation-defining portions for interlocking engagement therewith.

With reference again to the FIG. 4 embodiment, a further important feature is the provision of an aperture 64 opposite the body opening 66 defined by the lip 22 (FIG. 4) or opening 661 in body platform 601 (FIG. 5) and directly downstream of the nozzle outlet 38 so that the stream of cleaning liquid delivered directionally from the nozzle passes directly to the surface S to be cleaned, free of the pad 46 and untrammelled thereby to maximize fresh cleaning material at such surface and to permit the working of the cleaning liquid by absorbtion and release, repetitively by the pad to the surface, lifting dirt from the surface in manipulation of the tool.

It will be observed that the pad 46 is forwardly tapered at 68 for corner entry and on all sides extends beyond the cleaning head 18, and peripherally unsupported, for cleaning conformance of the pad extremities 70 with the surface S, see FIG. 1.

I claim:

1. An in-use regenerable, hand held surface cleaning and scrubbing tool having a cleaning-scrubbing head and a cleaning liquid containing aerosol can having a finger actuable nozzle for directional delivery of cleaning liquid therefrom onto a surface to be scrubbed and forming a handle for scrubbing manipulation of the head, said cleaning head comprising a generally cylindrical synthetic, organic thermoplastic bracket rigidly supported on the can in nozzle surrounding relation and defining a finger access hole adjacent said nozzle, a locally apertured fluid permeable, resilient scrub pad having interior reticulations carried by said bracket in peripherally unsupported relation for conforming engagement with curved surfaces to be scrubbed and with its aperture disposed in registration with said nozzle opening for free fluid passage through said pad aperture onto a surface to be scrubbed, said pad being coupled to said bracket at an angle of about 45° to the can longitudinal axis by locally deflected bracket extensions within the pad interior having engagement with the reticulation-defining portions of said pad to support said pad during the scrubbing operation-regeneration of absorbed cleaning liquid in the pad and responsive to repeated surface delivery of said cleaning liquid onto said surface through said registered opening and aperture.

2. Tool according to claim 1 in which said pad is fibrous.

3. Tool according to claim 2 in which said bracket extension is discontinuous within the pad interior and locally flow-deflected into interlocking engagement with the pad fibers.

4. Tool according to claim 2 in which said bracket extension is circularly continuous within the pad interior and locally flow-deflected into interlocking engagement with pad fibers.

5. Tool according to claim 1 including also means supporting said bracket on said can, said means comprising bracket continuations defining circularly differentiated detent structure in can chime engagement releasably retaining said bracket on said can rearwardly of said nozzle.

6. Tool according to claim 1 in which said pad is forwardly tapered beyond the bracket.

7. Tool according to claim 6 in which said pad comprises a reticulated mat of short fibers bonded at their intersections, to define said pad reticulations, said bracket extension being locally deflected into fiber interlocked engagement.

8. In an in-use regenerable, hand-held surface cleaning and scrubbing tool comprising a fluid-permeable, resilient scrub pad having interior reticulations, a pad support bracket, a hand-holdable aerosol can containing cleaning liquid under dispensing pressure, and means supporting said bracket on said can, said means comprising bracket continuations defining circularly differentiated detent structure in can chime engagement securely retaining said bracket on said can rearwardly of said nozzle in scrubbing orientation of said can and releasably for separation on tipping relative to the can; said can defining a bracket handle for scrubbing manipulation of the pad and having a finger-actuable nozzle for directional delivery of cleaning liquid therefrom repetitively onto a surface during scrubbing, said pad having an aperture freely passing directionally-delivered cleaning liquid from said nozzle directly onto said surface to be releasably absorbed into said pad from said surface during scrubbing, said bracket having an opening in registration with said pad aperture, the pad engaging means comprising a bracket extension surrounding said bracket opening and projecting into said pad circumferentially of the pad aperture and in locally deflected, interlocking relation with interior pad portions defining said pad reticulations to support said pad during the scrubbing operation-regeneration of absorbed cleaning liquid in the pad and responsive to repeated surface delivery of said cleaning liquid onto said surface through said registered opening and aperture.

9. Regenerable scrubbing tool according to claim 5 in which said bracket extension defines a generally curvilinear continuous edge within the pad interior.

* * * * *